United States Patent [19]

Hand

[11] 4,357,983

[45] Nov. 9, 1982

[54] ENCOMPASS DRAPERY SUPPORT ASSEMBLY

[76] Inventor: William A. Hand, 3161 Sullivant Ave., Columbus, Ohio 43204

[21] Appl. No.: 226,423

[22] Filed: Jan. 19, 1981

[51] Int. Cl.[3] ..... A47H 5/00

[52] U.S. Cl. ..... 160/345

[58] Field of Search ..... 160/19, 123, 124, 125, 160/126, 330, 331, 340, 341, 342, 343, 344, 345, 346, 347; 248/254, 256, 262, 265; 211/105.2, 123

[56] References Cited

U.S. PATENT DOCUMENTS

| | | | |
|---|---|---|---|
| 2,219,075 | 10/1940 | Veau | 160/345 |
| 2,238,984 | 4/1941 | Richardson | 160/346 |
| 2,627,915 | 2/1953 | Degnan et al. | 160/346 |
| 2,658,572 | 11/1953 | Vallen | 160/346 |
| 2,966,696 | 1/1961 | Young | 160/19 |
| 3,248,749 | 5/1966 | Williams | 160/345 |
| 3,392,420 | 7/1968 | Kless | 160/346 |

FOREIGN PATENT DOCUMENTS

| | | | |
|---|---|---|---|
| 114907 | 4/1918 | United Kingdom | 160/347 |

*Primary Examiner*—Peter M. Caun
*Attorney, Agent, or Firm*—Robert B. Watkins

[57] ABSTRACT

A drapery supporting assembly constructed to hold draperies or curtains in a position to form around and encompass furniture pieces and other objects which are placed adjacent thereto. A plurality of guides are provided within the assembly to reduce the friction imposed on drapery cords as they pass around arcuate portions of the frame member of the assembly during traversing operations.

6 Claims, 4 Drawing Figures

ENCOMPASS DRAPERY SUPPORT ASSEMBLY

SUMMARY OF THE INVENTION

This invention relates to a drapery support assembly. More particularly, it relates to an apparatus for supporting draperies in a position to encompass furniture pieces and furnishings along the walls and at the windows of a room in a dwelling or other structure.

Briefly and in summary, the invention is a drapery supporting assembly constructed to hold and maintain draperies in vertical parallel position relative to the walls of a room, and it comprises: an elongated drapery support frame member which is formed with end portions outstanding to the wall of the room. The end portions are connected to intermediate portions that are parallel to the wall of the room, and the intermediate portion is connected to return portions that are formed toward the wall of the room. A mid portion is connected between the return portions and is substantially parallel to the wall of the room. At least one wall bracket is attached to the frame member and is provided with attachment means to the wall of the room. The return portion and mid portion serve to encompass the furniture piece or other furnishings between the return portions.

Further in summary, this invention comprises a curvilinear drapery support frame member formed in cross-section as a channel having parallel upper and lower sides which are connected by substantially curved or perpendicular ends, with a continuous aperture on the lower side throughout the length of the frame member. Curved portions of the support frame member are provided with guide members within the channel. A drapery cord is positioned within the channel of the frame member, guided by the guide members. A plurality of slides are positioned and constructed to move within the aperture of the channel when connected to a drapery or curtain material, and the cord is connected to at least one of the sides. The guide members may be rollers.

It is a common and well known practice to support pliable fabric draperies in front of windows and along the walls of rooms in a dwelling structure; and there have been many various means for holding them in place, supporting them in various configurations, and providing means to move them back and forth along the wall, to cover or uncover a window or other feature on the wall. In the past, drapery supporting assemblies and apparatus, have been constructed generally straight and parallel with respect to the wall they are intended to cover. The usual supporting assembly comprises, in general, a substantially straight rod fastened parallel to slightly apart or away from the wall, a distance of a few centimeters (i.e. about 2 to 8 inches). These drapery supporting assemblies are commonly called drapery rods and, in many instances are of the traverse variety, with provision that the hooks supporting the drapery material are constructed to slide back and forth either in or on the transverse rod assembly. Of course, in doing so, the drapery fabric moves back and forth covering and uncovering the wall or window behind. Traverse rod drapery assemblies include cords and pulleys that are usually carried inside the traverse drapery rod. These are connected to the drapery supporting hooks and pull the draperies back and forth along the drapery rod.

Because of the friction of the various parts moving within the traverse drapery rod assembly, and particularly the vagueries in the convolutions of the drapery cord, there have been problems caused by the not uncommon event of tangles and stoppages in the operation of the apparatus.

Apparently, to avoid such problems and because of the simplicity involved, draperies have, in the past, primarily been straight and parallel to the wall which they are covering.

However, in some instances as shown by U.S. Pat. Nos. 2,798,558, 2,920,696 and 3,361,191, apparatus has been provided for traverse drapery operation in curved rods and assemblies. These prior art approaches have either been limited to gradual curvatures or have been very complex.

This invention is unlike the conventional drapery support assembly that provides for supporting a drapery that is hung from a straight rod or even a curved rod as in the above listed U.S. patents. The encompass drapery support assembly provides for supporting draperies from a curvilinear shaped track which provides an encompassing effect on whatever object is placed in front of the center of the assembly. The "object" can be anything from a piece of furniture to a furnishing such as a statue or a bouquet of flowers. The drapery support assembly is generally used at the windows of rooms in a dwelling structure, however, it could be used anywhere, even as a backdrop drapery support for anything that is put on display, even against a solid wall as at a convention center display.

It is a common practice to place furniture pieces and furnishings on the floor "in front of," i.e. in the area along the plane of the draperies and adjacent thereto. These furniture pieces are placed at varying distances from the plane of the drapes, in some instances rubbing against the drapes and in other instances set apart.

For purposes of definition in the description of this invention, the term drapery shall include curtains and other pliable fabric-like hangings commonly associated with the purposes for which the invention is intended. In addition, the terms straight and parallel and perpendicular surface of the drapery refers to the general plane presented by the drapery as a composite; it being understood, of course, that the drapery itself is folded, pleated, and generally "corrugated" or non-planar in appearance.

It is an object of this invention to provide a drapery supporting assembly that will suspend draperies and which will hold the draperies in vertical, parallel position relative to the vertical axis of the walls of a room, but in an encompassing, conforming formation around the shape of the furniture pieces and furnishings which are placed adjacent to the draperies. It is an object to provide the drapery supporting assembly in a curvilinear non-straight form causing the draperies to hang in a convoluted shape which encompasses furniture and furnishings nearby.

It is a further object to provide a drapery supporting frame member having internal, anti-friction means constructed therein, so that the drapery cord can readily pass through the curvilinear shape of the member causing the draperies to move and traverse through the convolutions and curves of the member. Still a further object of the invention is that the anti-friction means may be guides, wheels, or rollers uniquely positioned to reduce the friction associated with operating the traversing function of the drapery support assembly.

Other objects and features of the invention will be apparent and understood from the detailed description of the invention and the accompanying drawings which follow.

DETAILED DESCRIPTION OF INVENTION

Figure 1:
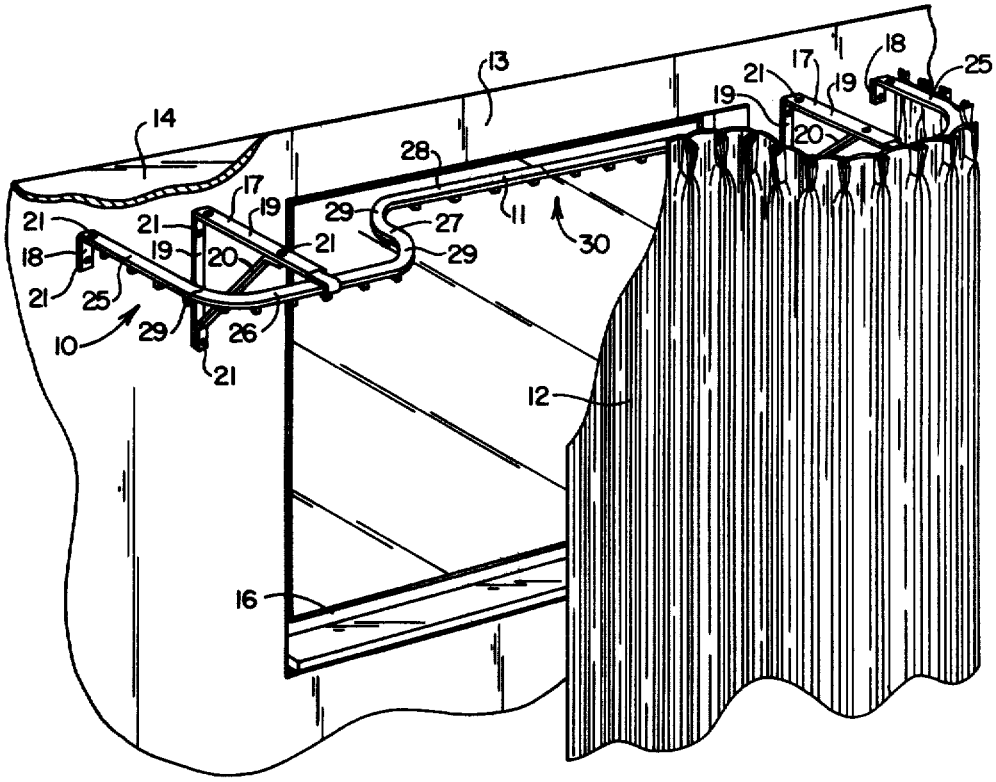
FIG. 1 is a partial perspective view of the apparatus of this invention viewed from a position elevated above the top of the drapery supporting assembly.
Figure 2:
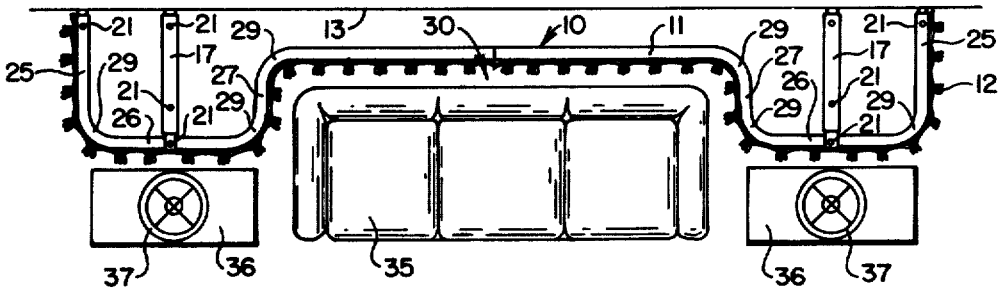
FIG. 2 is a plan view of the drapery support assembly of this invention together with furniture pieces and furnishings with which it is associated.

Referring to FIGS. 1 and 2 on which like numerals indicate the same parts, a drapery supporting assembly 10 comprises an elongated, curvilinear drapery support frame member 11 upon which draperies 12 are suspended. The frame member 11 is attached to a wall 13 near a ceiling 14 of a room in a dwelling structure. The draperies 12 may be hung to cover a window frame 16 on the wall 13.

The frame member 11 is attached and supported upon the wall 13 by wall brackets 17 and 18 at each end. The wall brackets 17 and 18 are conventional, having struts 19 and braces 20. Typically, screws 21 are used to fasten the various members together.

The drapery support frame member 11, is curvilinear in shape and fastened generally longitudinal and parallel with the wall 13. The curvilinear shape includes end portions 25 which are outstanding with respect to the wall 13. The end portions 25 are connected to intermediate portions 26 which are generally parallel to the wall 13. The intermediate portions 26 are connected to return portions 27 which are formed toward the wall 13. Return portions 27 are connected to a mid-portion 28 which is generally parallel to the wall 13.

In a preferred embodiment, the various portions 25, 26, 27, and 28 are connected by arcuate portions 29. The arcuate portions 29 are, in general, arcs of a circle in the horizontal plane of the drapery support frame member 11 when it is attached in place to the wall 13.

It is seen that the return portions 27 and the mid-portions 28 are formed to provide an indented section, designated generally as 30. When the draperies 12 are in place and hanging from the frame member 11, in a manner to be later described, the draperies present an indented mid-section in accordance with the shape of the indented mid-portions 28 of the frame member 11.

Referring to FIG. 2, by way of example, a piece of furniture, such as a sofa 35, is in front of the draperies 12, and other furnishings such as end tables 36, and lamps 37, are placed in a typical arrangement.

It will be seen that the draperies encompass the furniture piece 35 by generally following the contour along the back portion and the sides. This encompassing shape of the draperies provides a measure of closure, privacy, and feeling of security to the occupants of the sofa 35, and at the same time the situation is pleasing in appearance to those who view the assemblage, imparting some of the same sense of security and privacy to those who see the arrangement.

Additional comfort is provided to the occupants of the furniture pieces which are encompassed since drafts and the movement of air are generally reduced in the encompassed space.

As an additional advantage, the furniture or other object which is placed in the encompassed area is accentuated by being framed by the return portions of the drapery.

Although in some circumstances the frame member 11 may be a simple unitary piece of material such as a rod, on which the draperies and curtains are simply suspended with hooks or suspended by passing the rod through a fabric loop, in many other circumstances and in a preferred embodiment, the drapery support frame member 11 is constructed as a traversing type drapery apparatus. In this traversing type, the draperies move laterally in each direction to open and close the covering space on the wall 13 or window frame 16. A preferred means of practicing the traversing apparatus Referring to these figures, the frame member 11 comprises a channel formed cross-section having an upper side 40 and lower side 41 connected by substantially curved or perpendicular ends 42. The frame member 11 is usually formed into this cross-section from sheet metal which is rolled or folded to the desired shape.

Lower sides 41 are provided with an aperture 43 which continues throughout the length of the support frame member 11 and acts as a track for a plurality of slides 44. Within the frame member 11 is at least one, and usually two, flexible cords 45 which are attached to a slide 44 substantially at the center opening of the draperies 12.

Each slide 44 is constructed to receive a drapery hook 46 having a pointed end 47 which engages the upper end of the draperies 12 in a conventional manner.

The cords 45 pass over and engage rollers 50 at the end of the frame member 11 and descend down to a lower level where they can be pulled or manipulated to traverse the draperies.

In addition, at each arcuate portion 29 the frame member 11 a series of guide members are provided, preferably in the form of large roller guides 51, and small roller guides 52. The rollers guides 51 and 52 are positioned for rotation on a substantially vertical axis by a plurality of screws 50. The screws 53 may journal the rollers, or may support the rollers by fastening them to the upper side 40, if the rollers have self-contained ball or other bearings.

In normal operation, the cords 45 travel laterally in opposite directions so that as they pass over the roller guides they are on opposite sides of the large roller guides 51. The cord 45 which passes around the inside of the arcuate portion 29 passes over the outside of the small roller guides 52, keeping the inside cord from rubbing against the inside of the end 42.

By means of the arrangement of the pulleys 51, 52 and in particular, by the position of the small roller guides 52 between the large roller guides 51 the friction between the inside cord 45 and the inside of the arcuate portion 29 is reduced to a minimum.

In another less expensive embodiment, stationary guides may be substituted for the roller guides 51 and 52, respectively, stationary guides should be constructed of a relatively low-friction material such as "Teflon" or "Silastic" propolene plastic.

The successful operation of the traversing mechanism around the arcuate portions at the connections between the various straight portions of the frame member depends in a large measure on the weight of the drapery material of which the draperies are made. The type of guides 51 and 52, i.e. either rollers or stationary, may be selected depending on the various factors relating to the friction. Nevertheless, with a plurality of arcuate portions as required for the drapery support assembly of this invention, it is believed important and critical to the useful and successful operation that guides be provided to reduce the friction of the cords passing around the plurality of curves.

Figure 3:
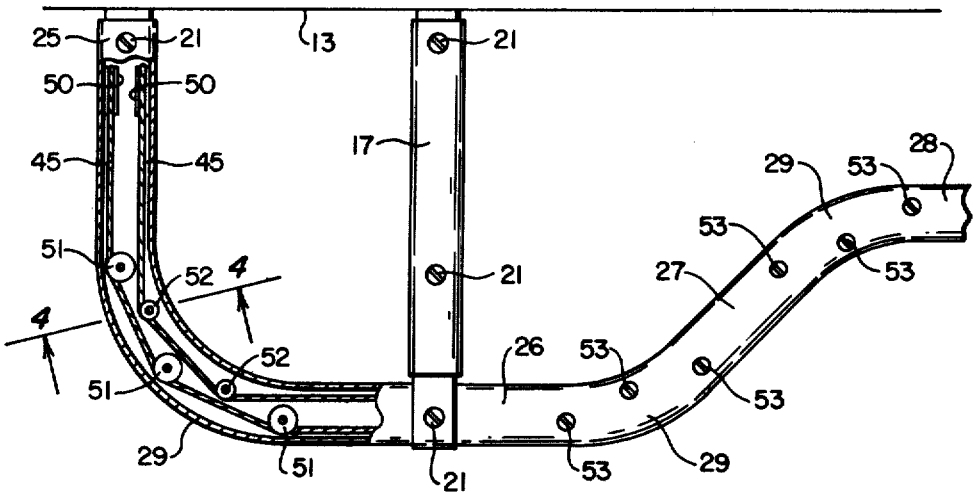
FIG. 3 is an enlarged partially sectional plan view of a portion of one end of the drapery support frame member of this invention.
Figure 4:
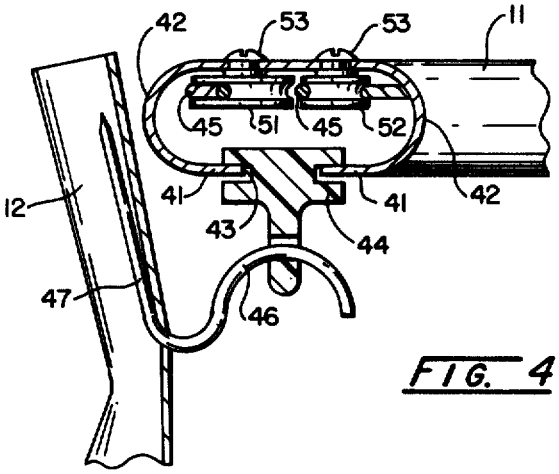
FIG. 4 is an enlarged sectional view taken along the line 4—4 of FIG. 3.

The return portion 27 may be substantially perpendicular to the wall 13, as shown in FIGS. 2 and 4, or may be oblique to wall as shown in FIG. 3.

While in the preferred embodiment, traversing type drapery apparatus is disclosed, in some instances it may only be necessary that the encompassing feature of the invention be used and traversing will not be necessary. In such instance, the curtain supporting frame rod may comprise end, intermediate, return, and mid-portions connected with relatively square and non-arcuate corners. The curtains may slide over the rod through a fabric loop and in such circumstances the draperies will remain relatively fixed. Where appropriate, the appended claims are to be construed to include this other than preferred embodiment.

It accommodates not only the conventional "pinch pleated" draperies, as shown in the drawings, but also accommodates the spring pleated type of draperies with pin glides, and most other drapery systems using a channel track. The parts unique to any of these above mentioned drapery systems can readily be used with the "encompassing rod." Thus, most any type of drapery style can be hung from an encompass traverse drapery support assembly.

It is herein understood that although the present invention has been specifically disclosed with the preferred embodiments and examples, modification and variations of the concept herein disclosed may be resorted to by those skilled in the art. Such modifications and variations are considered to be within the scope of the invention and the appended claims.

What is claimed is:

1. A drapery supporting assembly constructed to hold draperies or curtains in vertical parallel position relative to the vertical axis of the walls of a room, comprising:

(a) an elongated curvilinear shaped drapery support frame member, formed with end portions outstanding to the wall of the room, the end portions being connected to intermediate portions parallel to the wall of the room, the intermediate portions being connected to return portions formed toward the wall of the room, and a midportion connected between the return portions and substantially parallel to the wall of the room; the connections between the end portions, the intermediate portions, the return portions, and the mid-portions, being substantially archs of a circle;

(b) the drapery support frame member comprising a channel having parallel upper and lower sides connected by formed substantially curved or perpendicular ends, with a continuous aperture on the lower side throughout the length of the support frame, each arcuate connection between portions of the support frame having guide members within the channel and supported from the upper side, with a drapery cord positioned within the channel, guided by a guide members; and a plurality of slides are positioned and constructed to move within the aperture of the channel when connected to the drapery material, with the cord connected to at least one of the slides; and (c) at least one wall bracket attached to the drapery frame member, having attachment means to the wall of the room;

the return portons and midportion serving to encompass an object between the return portions.

2. A drapery assembly according to claim 1 wherein the guides are stationary.

3. A drapery assembly according to claim 1 wherein the guides are rollers.

4. A drapery assembly according to claim 1 wherein the return portions are substantially perpendicular to the wall of the room.

5. A drapery assembly according to claim 1 wherein the return portions are oblique to the walls of the room.

6. A drapery assembly according to claim 1 wherein the midportion is provided with adjustment means to vary the distance between the return portions in accordance with the size of the object.

* * * * *